US010174407B2

(12) United States Patent
Abkowitz et al.

(10) Patent No.: US 10,174,407 B2
(45) Date of Patent: Jan. 8, 2019

(54) OXYGEN-ENRICHED TI-6AI-4V ALLOY AND PROCESS FOR MANUFACTURE

(71) Applicant: Dynamet Technology, Inc., Burlington, MA (US)

(72) Inventors: Stanley Abkowitz, Burlington, MA (US); Susan M. Abkowitz, Burlington, MA (US); Patrick Connors, Gardner, MA (US); David Main, Milton, MA (US); Harvey Fisher, Lexington, MA (US)

(73) Assignee: Arconic Inc., Pittsburgh, PA (US)

( * ) Notice: Subject to any disclaimer, the term of this patent is extended or adjusted under 35 U.S.C. 154(b) by 882 days.

(21) Appl. No.: 14/374,430

(22) PCT Filed: Jan. 25, 2013

(86) PCT No.: PCT/US2013/023281

§ 371 (c)(1),
(2) Date: Jul. 24, 2014

(87) PCT Pub. No.: WO2013/162658

PCT Pub. Date: Oct. 31, 2013

(65) Prior Publication Data

US 2014/0377119 A1 Dec. 25, 2014

Related U.S. Application Data

(60) Provisional application No. 61/591,597, filed on Jan. 27, 2012.

(51) Int. Cl.

| | |
|---|---|
| ***C22C 14/00*** | (2006.01) |
| ***C22C 1/04*** | (2006.01) |
| ***C22C 1/10*** | (2006.01) |
| ***B22F 3/12*** | (2006.01) |
| ***B22F 3/24*** | (2006.01) |
| *B22F 3/04* | (2006.01) |
| *B22F 1/00* | (2006.01) |

(52) U.S. Cl.

CPC ..... *C22C 14/00* (2013.01); *B22F 3/12* (2013.01); *B22F 3/24* (2013.01); *C22C 1/0458* (2013.01); *C22C 1/10* (2013.01); *B22F 1/0003* (2013.01); *B22F 3/04* (2013.01); *B22F 2003/248* (2013.01); *B22F 2201/20* (2013.01); *B22F 2301/205* (2013.01); *B22F 2998/10* (2013.01)

(58) Field of Classification Search

None

See application file for complete search history.

(56) References Cited

U.S. PATENT DOCUMENTS

| | | | | |
|---|---|---|---|---|
| 2,754,204 | A | 7/1956 | Jaffee et al. | |
| 2,906,654 | A | 9/1959 | Abkowitz | |
| 4,943,412 | A | 7/1990 | Bania et al. | |
| 5,332,545 | A | 7/1994 | Love | |
| 5,489,411 | A * | 2/1996 | Jha | B22F 3/115 29/17.1 |
| 5,759,484 | A | 6/1998 | Kashii et al. | |
| 5,897,830 | A | 4/1999 | Abkowitz et al. | |
| 6,053,993 | A | 4/2000 | Reichman et al. | |
| 6,582,833 | B2 | 6/2003 | Toyoda et al. | |
| 6,979,375 | B2 | 12/2005 | Furutam et al. | |
| 8,043,404 | B2 | 10/2011 | Abkowitz et al. | |
| 2005/0234561 | A1 | 10/2005 | Nutt et al. | |
| 2006/0157543 | A1 | 7/2006 | Abkowitz | |
| 2011/0232349 | A1 | 9/2011 | Hebda et al. | |
| 2013/0315773 | A1 * | 11/2013 | Moxson | C01B 6/02 419/28 |

FOREIGN PATENT DOCUMENTS

WO WO 2013/162658 10/2013

OTHER PUBLICATIONS

Abkowitz, S. Feasibility Study for the Qualification of an Economically Advantageous Ti-6AI-4V Bearing Housing for Gas Turbine Engine Application by Powder Metal Manufacturing Technology. Dynamet.

Technology Inc., Burlington MA, Jan. 1991: pp. 9-11, 13, 17; Table II: Table IV; Table IVa.

PCT International Search Report, International application No. PCT/US13/23281, International filing date Jan. 25, 2013.

PCT Notification of Transmittal of The International Search Report and The Written Opinion of the International Searching Authority, or the Declaration, International application No. PCT/US13/23281, International filing date Jan. 25, 2013.

Supplemental European Search Report, EP 13 78 2301, dated Jul. 15, 2015, 2 pages.

Annex to the European Search Report on European Patent Application No. , EP 13 78 2301, dated Jul. 16, 2015, 5 pages.

* cited by examiner

*Primary Examiner* — Jessee R Roe
*Assistant Examiner* — Ngoclan T Mai
(74) *Attorney, Agent, or Firm* — Greenberg Traurig, LLP

(57) ABSTRACT

A titanium alloy comprising an elevated level of oxygen is disclosed. The alloy may have 5.5 to 6.75 weight percent of aluminum, 3.5 to 4.5 weight percent of vanadium, 0.21 to 0.30 weight percent of oxygen, and up to 0.40% of weight percent of iron. The alloy may also have a minimum ultimate tensile strength of 130,000 psi, a minimum tensile yield strength of 120,000 psi, and a minimum ductility of 10% elongation. Also disclosed is a method for manufacturing components having the aforementioned alloy.

6 Claims, 2 Drawing Sheets

OXYGEN-ENRICHED TI-6AI-4V ALLOY AND PROCESS FOR MANUFACTURE

CROSS REFERENCE TO RELATED APPLICATIONS

This application is a national phase filing of PCT/US2013/023281, filed Jan. 25, 2013, which claims priority to U.S. Provisional Patent Application No. 61/591,597, filed Jan. 27, 2012, the content of both incorporated herein by reference in their entirety.

FIELD

Embodiments of the present disclosure generally relate to titanium metal alloys. Specifically, embodiments of the present disclosure relate to oxygen-enriched Ti-6Al-4V alloys formed using powdered metals as starting materials. Oxygen enrichment of Ti-6Al-4V refers to an increased oxygen content of Ti-6Al-4V metal alloy material in order to improve the properties of Ti-6Al-4V, such as, for example, to enhance strength or ductility properties. Embodiments of the present disclosure also encompass related methods for manufacturing products formed from oxygen-enriched titanium alloys.

BACKGROUND

Titanium alloys have found extensive application in aircraft, military, medical, and industrial applications. One of the greatest uses of titanium has been in aircraft applications. Aerospace use accounts for over the titanium market. In particular, wrought Ti-6Al-4V alloy is the material most widely specified for use in aircraft applications. See ASM Metals Handbook Grade 5, AMS Spec. 4906, ASTM Spec. 6348.

The primary titanium alloy currently used is the Ti-6Al-4V alloy (over 70%), which was first described in U.S. Pat. No. 2,906,654. The basic manufacturing process used to produce titanium components has been the double consumable arc melting process. This process produces ingots of titanium alloy which must be further processed into billets. They are then formed into a bar or plate, which are typically machined to form a final component. While this and similar manufacturing processes have been used for over 60 years ago, they are generally energy intensive, suffer from high material losses in processing, and are costly. See Titanium in Industry (Van Nostrand 1955), Abkowitz, Burke and Hiltz, and Emergence of the Ti Industry and the Development of the Ti-6Al-4V Alloy (JOM Monograph 1999), S. Abkowitz.

Among potential alternate manufacturing technologies aimed at producing a lower cost titanium product, various powder metal approaches (including the low cost elemental blend powder metallurgy) have been investigated. Niche applications for these "non-melt" processes have been developed. See Titanium Powder Metallurgy: A Review—Part 2, F. H. Froes, Advanced Materials & Processes; October 2012, Vol. 170 Issue 10.

While non-melt processes, i.e., processes that do not involve melting, such as powder metallurgical processes, can produce practical titanium alloys, the resulting mechanical properties of some of the titanium material produced from powdered starting materials could not consistently meet some specific requirements. For example, some non-melt titanium alloys do not meet the minimum tensile and ductility requirements of Ti-6Al-4V wrought product without subsequent thermal mechanical processing, such as, for example, hot working. These lower mechanical properties and other limitations have generally reduced the ability to substitute powder metal Ti-6Al-4V alloys for the traditional wrought Ti-6Al-4V alloys.

Mechanical properties of titanium alloy e also affected by the presence of different elements in the metal material. For example, oxygen has long been recognized as one of the most important and most troublesome constituents in titanium. It is well known that increasing the oxygen content, or content of other interstitial elements such as nitrogen, hydrogen and carbon, decreases the ductility of conventionally processed titanium alloys such as Ti-6Al-4V. Consequently, elevated oxygen content is generally considered severely detrimental to ductility of a wrought titanium product (i.e., produced from ingot melted material).

In addition, oxygen has significant interstitial solubility in titanium. That is, oxygen can dissolve into titanium material and the solute oxygen atoms can take up positions within the titanium alloy lattice structure i.e., interstitially. While interstitial oxygen offers a strengthening effect, it degrades ductility. It is believed that interstitials influence slip planes and dislocations by impeding their movement, thereby increasing strength and decreasing ductility. For at least this reason, the oxygen content of wrought Ti-6Al-4V is limited to 0.20% maximum. And oxygen content above that level is considered too deleterious for commercial use. See "The Effects of Carbon, Oxygen, and Nitrogen on the Mechanical Properties of Titanium and Titanium Alloys," H. R. Ogden and R. I. Jaffee, TML Report No. 20, Oct. 19, 1955, Titanium Metallurgical Laboratory, Battelle Memorial Institute, Columbus 1, Ohio.

As described below, the present disclosure is directed to an oxygen-enriched titanium alloy formed using powder metals that overcomes at least some of these prior art limitations.

SUMMARY

The present disclosure generally describes a modified Ti-6Al-4V alloy, a powder metal manufacturing process, and products made thereof. For example, an oxygen-enriched Ti-6Al-4V alloy having near-net preform shapes can be produced by pressing and sintering to approximately 98% of theoretical density, the balance being voids absent any solid material. The powder metal manufacturing process described herein can involve blending of titanium powder and other metal powders. This blend may then be pressed at high pressure to form a shaped compact. The compact may have a density of approximately 85% of theoretical density, where theoretical density is the known density for a given alloy free of voids. The shaped compact can then be sintered in a vacuum furnace at a temperature sufficient to diffuse the powder constituents to form a homogeneous titanium alloy. A shaped component with a density of approximately 95% of theoretical density can be produced. The sintered component may then be further processed by hot isostatic pressing (HIP), which can include heating the sintered component to an elevated temperature in pressurized gas, such as, for example, argon gas. The combination of temperature and gas pressure densifies the product, resulting in essentially 100% of theoretical density.

In some embodiments, a material produced using the above method can achieve the tensile properties specified for wrought Ti-6Al-4V alloy production. Such an oxygen-enriched titanium alloy can, in certain situations, also meet the acceptability requirements for use in select commercial aircraft applications. See AeroMat Conference May 25, 2011 Abstract, New Era in Titanium Manufacturing Powder Metal Components ("The data generated demonstrate excellent product quality with a high degree of reproducibility."), and Press Release, "Dynamet Technology Approved by Boeing as Qualified Supplier For PM Titanium Alloy Products," (Feb. 8, 2012) (on file with Applicant.)

In one aspect, a titanium alloy can include 5.5 to 6.75 weight percent of Aluminum, 3.5 to 4.5 weight percent of Vanadium, up to 0.40 weight percent of Iron, and 0.21 to 0.30 weight percent of Oxygen. The alloy can have at least one of a minimum ultimate tensile strength of at least about 130,000 psi, a minimum tensile yield strength of at least about 120,000 psi, a minimum ductility of at least about 10% elongation, or about 20% minimum reduction in area.

In another aspect, a titanium alloy material can include titanium, about 5.50 to about 6.75 weight percent of Aluminum, about 3.50 to about 4.50 weight percent of Vanadium, less than about 0.40 weight percent of Iron and greater than about 0.21 weight percent of Oxygen. The titanium alloy can have a minimum ultimate tensile strength of at least about 130,000 psi, a minimum tensile yield strength of at least about 120,000 psi, and a minimum ductility of at least about 10% elongation.

In another aspect, a method of making a component formed of an oxygen-enriched Ti-6Al-4V alloy can include blending a titanium powder and an aluminum-vanadium master alloy powder to form a blend and pressing the blend to form a pressed product having a form substantially similar to the form of the component. The method can also include vacuum sintering the pressed product for a time sufficient and controlled thermal process conditions for heating and cooling to form a sintered titanium alloy, wherein the oxygen-enriched Ti-6Al-4V alloy can have at least about 0.21% oxygen.

Additional objects and advantages of the present disclosure will be set forth in part in the description which follows, and in part will be obvious from the description, or may be learned by practice of the present disclosure. The objects and advantages of the present disclosure will be realized and attained by means of the elements and combinations particularly pointed out below.

The term "about" is intended to mean approximately, in the region of, roughly, or around. When the term "about" is used in conjunction with a numerical range, it modifies that range by extending the boundaries above and below the numerical values set forth. Unless otherwise indicated, it should be understood that the numerical parameters set forth in the following specification and attached claims are approximations. At the very least, and not as an attempt to limit the application of the doctrine of equivalents to the scope of the claims, numerical parameters should be read in light of the number of reported significant digits and the application of ordinary rounding techniques.

It is to be understood that both the foregoing general description and the following detailed description are exemplary and explanatory only and are not restrictive of the present disclosure.

BRIEF DESCRIPTION OF THE DRAWINGS

The accompanying drawings, which are incorporated in and constitute a part of this specification, illustrate several embodiments of the present disclosure and together with the description, serve to explain the principles of the present disclosure.

DESCRIPTION OF THE EMBODIMENTS

Reference will now be made in detail to exemplary embodiments of the present disclosure, examples of which are illustrated in the accompanying drawings.

As described above, the oxygen content of some titanium alloys is never more than 0.20% because higher oxygen content negatively affects some mechanical properties of the alloy. In contrast to conventional wisdom, the titanium alloy material described herein tolerates a much higher level of oxygen without degrading ductility. While not bound by theory, we hypothesize that some of the oxygen may not be present in the form of interstitial oxygen but in some other form, such as, for example, a metallic oxide (e.g. titanium dioxide). Metallic oxides in the resulting structure could remain present or form from surface oxides introduced from the raw material powder blend. We have found that oxygen levels of approximately 0.21% to 0.30% may be desirable in the oxygen-enriched alloy as they may strengthen Ti-6Al-4V without compromising ductility.

We also hypothesize that while the oxygen content of the alloy material described herein may be higher than for wrought Ti-6Al-4V, the other interstitial elements (such as, for example, nitrogen, hydrogen, and carbon) may be lower. A lower content of non-oxygen interstitials may offset the effect of the elevated oxygen interstitials. That is, the total interstitial content (comprising, for example, oxygen, nitrogen, hydrogen, and carbon) of the present alloy may be comparable to that of the total interstitial content of wrought Ti-6Al-4V. We expect that similar levels of total interstitial content of our titanium alloy and wrought Ti-6Al-4V would result in comparable material properties. In particular, these two alloys could possess comparable strength and ductility.

Grain size may also affect the properties of the titanium alloys described herein. It is well known that the larger the grain size of a particular material, the lower the strength and higher the ductility. This is known as the Hall-Petch effect. See Smith, William F.; Hashemi, Javad (2006), *Foundations of Materials Science and Engineering* (4th ed.), McGraw-Hill. However, it is also known that the impact of the Hall-Petch effect is different for different alloys. It is thus difficult to predict how the mechanical properties of certain alloys will vary with grain size.

Figure 1:
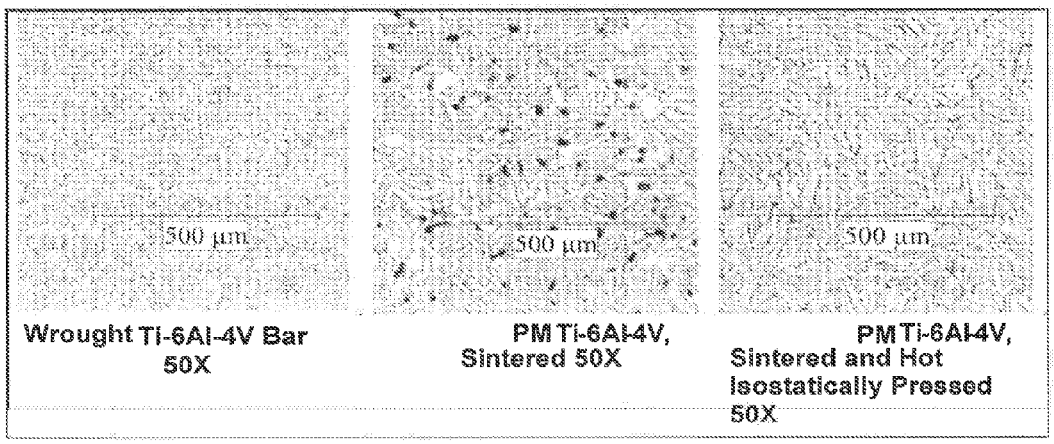
FIG. 1 shows a number of microstructures of the powder metal (PM) Ti-6Al-4V and the wrought Ti-6Al-4V product, according to several exemplary embodiments.

FIG. 1 shows the typical microstructure of wrought Ti-6Al-4V, the microstructure of the sintered alloy material described herein, and the microstructure of the sintered alloy material described herein after hot isostatic pressing. Also shown is the grain size of each material. The grain size of the alloy material described herein is approximately twice that of the wrought Ti-6Al-4V. But despite having much larger grains than wrought Ti-6Al-4V, the present alloy materials possess strength and ductility comparable to wrought titanium alloy. Therefore, we believe that the impact of the Hall-Fetch effect is different for the powder metal (PM) Ti-6Al-4V alloy material described herein than the wrought Ti-6Al-4V material. Thus, there may be several or other mechanisms influencing the properties of the present alloy.

Table 1 compares select properties of commercial wrought Ti-6Al-4V alloy and oxygen-enriched powder metal (PM) Ti-6Al-4V alloy described herein. Specifically, the wrought Ti-6Al-4V Alloy is Grade 5, Spec. AMS 4906, ASTM B348, MIL-T9046. As shown in the chemical analyses data of Table 1, most Ti-6Al-4V alloy industry specifications thus limit the oxygen content to a maximum value of 0.2% by weight. Some titanium casting specifications allow for up to 0.25% oxygen, but this necessitates relaxing the ductility specification from the wrought product standard of 10% minimum elongation to 8%, or sometimes 6% minimum elongation. Oxygen content above 0.25% is known to be even more severely detrimental to ductility. However, in contrast to conventional understanding and titanium alloys currently available, we describe herein a Ti-6Al-4V alloy formed from powdered metal that can tolerate oxygen content of at least about 0.30% without significant degradation of ductility.

TABLE 1

Typical Chemistry for Ti—6Al—4V Alloys Showing Commercial Wrought Alloy vs. the Present Powder Metal (PM) Alloy

| Alloy | Al % max | V % max | Fe % max | C % max | O % max | H % max | N % max | Other Elements % max |
|---|---|---|---|---|---|---|---|---|
| Ti—6Al—4V, Wrought | 5.5-6.75 | 3.5-4.5 | 0.40 | 0.10 | 0.20 | 0.015 | 0.05 | 0.10 each 0.50 total |
| Ti—6Al—4V, PM | 5.5-6.75 | 3.5-4.5 | 0.40 | 0.10 | 0.30 | 0.015 | 0.05 | 0.10 each 0.50 total |

Table 2 shows the tensile properties of wrought Ti-6Al-4V compared with PM Ti-6Al-4V described herein. As the data shows, the PM titanium alloy can meet the same specified requirements as the wrought Ti-6Al-4V even though the density of PM Ti-6Al-4V may be lower than for the wrought material. Those skilled in the art would have expected sintered PM Ti-6Al-4V to have a lower density, and thus lower strength and lower ductility than wrought material. In fact the sintered PM Ti-6Al-4V has comparable strength and ductility even though it has lower density. Obtaining strength and ductility of wrought Ti-6Al-4V in a PM shaped product at a lower total product cost provides a strong incentive to use PM product as an alternative to conventional wrought titanium ahoy products.

TABLE 2

Minimum Tensile Property for Ti—6Al—4V Alloy Showing Commercial Wrought Alloy vs. Present Powder Metal (PM) Alloy

| Alloy | UTS (ksi) Min. | YS (ksi) Min. | EI (%) Min. | RA (%) Min. | Density (Lbs./in$^3$) Min |
|---|---|---|---|---|---|
| Ti—6Al—4V, Wrought | 130 | 120 | 10 | 20 | .160 (100% of theoretical) |
| Ti—6Al—4V, PM | 130 | 120 | 10 | 20 | .157 (98% of theoretical) |

Table 3 shows comparative data for two different blends of oxygen-enriched sintered PM Ti-6Al-4V alloys. As the data shows, there can be relatively little difference in properties between the different blends of PM titanium alloys, demonstrating the reproducibility of the process. Such reproducibility can be critical for certain applications where variability of mechanical properties can render parts made of such materials completely unsuitable for commercial use.

TABLE 3

Tensile Properties of Different Blends of Oxygen-Enriched Sintered PM Ti—6Al—4V Alloys

| Blend No. | Oxygen (%) | UTS (ksi) | YS (ksi) | EI (%) | RA (%) | Density Lbs./in$^3$ |
|---|---|---|---|---|---|---|
| Blend 1 | 0.269 | 139.6 | 122.8 | 13.4 | 30.8 | 0.158 |
| Blend 2 | 0.298 | 140.4 | 123.0 | 13.6 | 28.3 | 0.158 |

The tensile and density properties for several blends of oxygen enriched sintered PM Ti-6Al-4V subjected to hot isostatic pressing (HIP) are shown in Table 4. This table again demonstrates the reproducibility of the powder metal manufacturing process described herein. Such low variation of oxygen content among the various blends can be difficult or impossible to achieve with other powder metal methods of producing similar titanium alloys.

TABLE 4

Typical Tensile Properties of Oxygen-Enriched Sintered + HIP'd PM Ti—6Al—4V

| Blend No. | Oxygen (%) | UTS (ksi) | YS (ksi) | EI (%) | RA (%) | Density Lbs./in$^3$ |
|---|---|---|---|---|---|---|
| Blend 1 | 0.269 | 142.8 | 127.7 | 13.6 | 34.5 | 0.160 |
| Blend 3 | 0.255 | 140.7 | 126.0 | 13.8 | 34.2 | 0.160 |
| Blend 4 | 0.285 | 140.0 | 123.0 | 14.7 | 39.9 | 0.160 |
| Blend 5 | 0.250 | 139.7 | 122.8 | 14.7 | 34.0 | 0.160 |
| Blend 6 | 0.260 | 143.2 | 126.7 | 13.4 | 29.5 | 0.160 |

Direct HIP processing to produce PM Ti-6Al-4V product requires Ti-6Al-4V pre-alloyed powders be encapsulated into a metal can, sealed, and evacuated before hot is statically pressing and subsequent can removal to produce the PM product. This process is expensive.

In the process described herein, the sintered PM shapes (having, for example, a density of about 95% of theoretical density) may be further consolidated to a higher density product by hot isostatically pressing without costly canning to produce a product that reaches essentially 100% of theoretical density. HIP essentially eliminates residual voids, thereby increasing the density, thus improving both strength and ductility.

FIG. 1 shows the typical microstructure of wrought Ti-6Al-4V, the microstructure of sintered PM Ti-6Al-4V, and the microstructure of sintered and hot isostatically pressed PM Ti-6Al-4V. Also shown is the grain size of each material. The black areas in the microstructure of the sintered PM Ti-6Al-4V are voids indicative of the somewhat lower density of the sintered material.

As shown, the grain size of the PM Ti-6Al-4V materials is approximately twice that of the wrought Ti-6Al-4V. Specifically, the average grain size of the wrought Ti-6Al- 4V is about 4.7 microns. In contrast, the average grain size for PM Ti-6Al-4V sintered is about 9.4 microns and the average grain size for PM Ti-6Al-4V Sintered+HIP material is about 11.2 microns.

Despite having much larger grains then wrought Ti-6Al-4V, the PM titanium alloy materials possess strength and ductility equivalent to wrought titanium alloys. The larger grain size with similar yield stress exhibited in the PM Ti-6Al-4V material thus differentiates it from the existing wrought product. The PM titanium materials can also have other characteristics that differentiate them from wrought titanium alloys.

As discussed above, there are a number of other factors that could potentially contribute to this effect. We believe the effects may be related to some combination of the form and location of oxygen in the lattice structure, the total interstitial content, and/or the nature of the Hall-Petch effect. Manufacturing processes may also affect properties. For example, the PM Ti-6Al-4V can be produced through a controlled solid-state diffusion with limited molecular mobility. In comparison, wrought titanium alloys are produced using liquid-state diffusion of melted product.

Another contributing factor may be the energy required for sintering compared to the energy required for melting. Energy input during sintering may be insufficient to convert metal oxides to interstitial elements. In contrast, the energy input during vacuum melting could readily convert metal oxides to interstitial elements. The presence of some portion of the oxygen as metal oxides may inhibit dislocation movement which may result in a higher starting stress for dislocation movement, thereby increasing strength.

It is also possible that other interstitials or other minor elements could be contributing to the unexpected high ductility despite the high oxygen content. Increased ductility may also result from dislocations being able to move more freely through vacancies or fine residual porosity developed through this solid state diffusion processing of the alloys described herein.

To manufacture the PM titanium alloys described herein, titanium metal powder and aluminum-vanadium master alloy powder may be blended. Titanium metal powder of various mesh particle size may be used. For example, the titanium metal powder may have a typical powder size less than 420 microns (i.e., −40 mesh), or less than 260 microns (i.e., −60 mesh).

Following sufficient blending, the powders are generally processed by pressing and sintering, and optionally by hot isostatic pressing. For example, a blend of powders may be pressed and sintered to produce a high density (approximately 98% of theoretical density) consolidated shape. Pressing could include cold pressing or cold isostatic pressing. The tensile properties achieved are demonstrated to meet the minimum tensile properties generally specified for Ti-6Al-4V alloy wrought product.

The manufacturing process may require various combinations of particle size, compaction parameters, and sintering parameters. A number of combinations may be appropriate to provide the desired microstructural and mechanical properties for any given part. Typical embodiments and the process involve the blending of oxygen-enriched titanium metal powder and aluminum-vanadium master alloy powder, cold isostatic pressing, and vacuum sintering. For example, cold pressing may include a pressure ranging from about 40,000 to about 100,000 psi. Sintering may include a minimum vacuum of about $10^{-3}$ torr, preferably less than $10^{-4}$ torr. Sintering temperature may range from about 2,000° F. to about 2,500° F. under controlled thermal cycle of heating and cooling for a sufficient time e for adequate diffusion, typically in the range of 2-10 hours.

Figure 2:
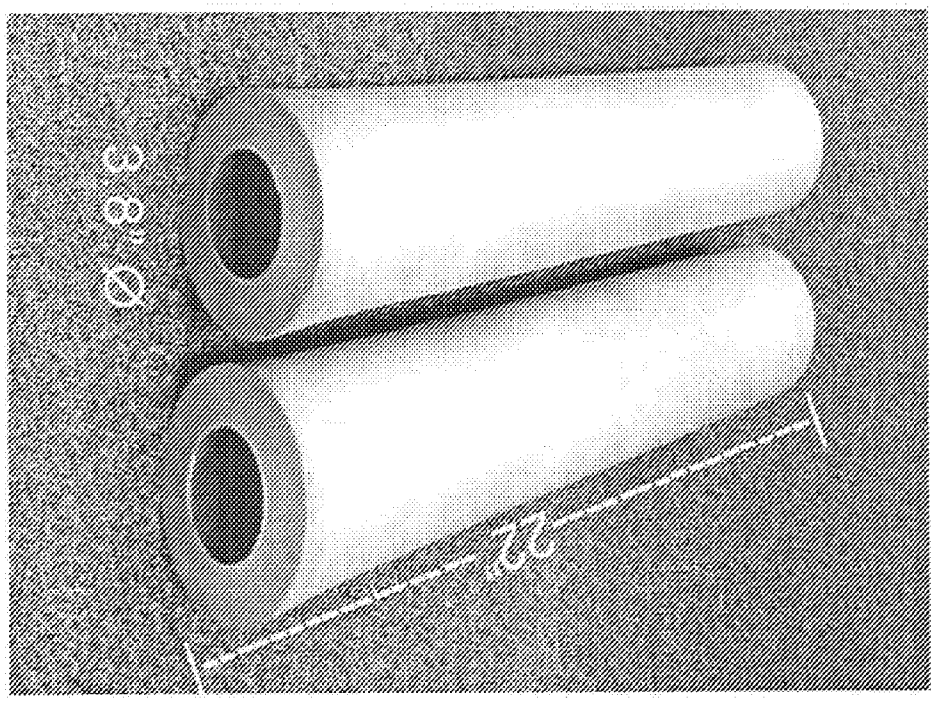
FIG. 2 shows Ti-6Al-4V oxygen enriched tubular shaped components produced by a powder metal manufacturing process, according to an exemplary embodiment. The component on the left is sintered and then hot isostatic pressed to essentially 100% of theoretical density. The component on the right is sintered to 98% of theoretical density.

FIG. 2 shows oxygen enriched Ti-6Al-4V alloy tubular shaped components produced by the powder metal manufacturing process, according to an exemplary embodiment. The component on the left is sintered and then hot isostatic pressing to essentially 100% of theoretical density. The component on the right is sintered to 98% of theoretical density. The objects are approx. 3.8 inches in outer diameter and about 22 inches in length.

It will be apparent to those skilled in the art that various modifications and variations can be made in the disclosed materials and methods without departing from the scope of the present disclosure. For example, other modifications to the methods described herein or variations in percentages of types of constituents of the alloys described herein. Other embodiments of the present disclosure will be apparent to those skilled in the art from consideration of the specification and practice of the present disclosure disclosed herein. It is intended that the specification and examples be considered as exemplary only.

What is claimed is:

1. A titanium alloy, comprising:

5.5 to 6.75 weight percent of aluminum, 3.5 to 4.5 weight percent of vanadium, up to 0.40 weight percent of iron, and 0.21 to 0.30 weight percent of oxygen, and having a minimum ultimate tensile strength of at least about 130,000 psi, a minimum tensile yield strength of at least about 120,000 psi, a minimum ductility of at least about 10% elongation, and wherein a microstructure of the titanium alloy includes an average grain size of at least 8 microns.

2. The titanium alloy of claim 1, wherein the microstructure includes a plurality of voids totaling about 2% by volume.

3. The titanium alloy of claim 1, wherein the titanium alloy has a minimum density of at least about 98% of theoretical density.

4. A titanium alloy material consisting essentially of:

titanium;

about 5.50 to about 6.75 weight percent of aluminum;

about 3.50 to about 4.50 weight percent of vanadium;

less than about 0.40 weight percent of iron; and greater than about 0.21 weight percent of oxygen, wherein the titanium alloy has a minimum ultimate tensile strength of at least about 130,000 psi, a minimum tensile yield strength of at least about 120,000 psi, a minimum ductility of at least about 10% elongation, and wherein an average grain size of the titanium alloy is at least about 8 microns.

5. The titanium alloy of claim 4, wherein the titanium alloy includes a plurality of voids totaling less than about 2% by volume.

6. The titanium alloy of claim 4, wherein the titanium alloy has a minimum density of at least about 98% of theoretical density.

* * * * *